US009808097B2

(12) United States Patent
Whitt et al.

(10) Patent No.: US 9,808,097 B2
(45) Date of Patent: Nov. 7, 2017

(54) TODDLER STADIUM CHAIR

(71) Applicants: Nancy Whitt, Enterprise, AL (US); James Cawley, Enterprise, AL (US)

(72) Inventors: Nancy Whitt, Enterprise, AL (US); James Cawley, Enterprise, AL (US)

( * ) Notice: Subject to any disclaimer, the term of this patent is extended or adjusted under 35 U.S.C. 154(b) by 79 days.

(21) Appl. No.: 15/051,775

(22) Filed: Feb. 24, 2016

(65) Prior Publication Data

US 2017/0238719 A1 Aug. 24, 2017

(51) Int. Cl.

| | |
|---|---|
| ***A47D 1/10*** | (2006.01) |
| ***A47C 1/16*** | (2006.01) |
| ***A47D 15/00*** | (2006.01) |
| ***A47D 1/00*** | (2006.01) |
| ***A47D 1/02*** | (2006.01) |
| *A47C 4/04* | (2006.01) |
| *A47C 4/02* | (2006.01) |
| *A47C 7/02* | (2006.01) |
| *A47C 7/42* | (2006.01) |

(52) U.S. Cl.

CPC ..... *A47D 1/10* (2013.01); *A47C 1/16* (2013.01); *A47D 1/002* (2013.01); *A47D 1/02* (2013.01); *A47D 15/00* (2013.01); *A47D 15/006* (2013.01); *A47C 4/02* (2013.01); *A47C 4/04* (2013.01); *A47C 7/021* (2013.01); *A47C 7/42* (2013.01); *A47C 7/425* (2013.01); *A47D 1/103* (2013.01)

(58) Field of Classification Search

CPC ..... A47C 7/021; A47C 1/16; A47C 7/425; A47C 4/02; A47C 4/04; A47C 7/42; A47D 1/103

USPC ..... 297/188.08, 220, 219.1, 228.13, 188.2, 297/183.3, 217.7, 250.1, 253, 219.12, 297/254, 380

See application file for complete search history.

(56) References Cited

U.S. PATENT DOCUMENTS

| | | | | | |
|---|---|---|---|---|---|
| 2,473,312 | A * | 6/1949 | Thompson | B60N 2/2854 | 297/254 |
| 2,751,967 | A * | 6/1956 | Sitterley | A47D 1/103 | 297/256 |
| 2,774,411 | A * | 12/1956 | Berlin | B60N 2/283 | 297/256 |
| 4,718,717 | A * | 1/1988 | Cruz | A47C 9/06 | 297/135 |
| 5,470,039 | A | 11/1995 | Hilger | | |
| 5,516,193 | A * | 5/1996 | Simpson | A47C 4/52 | 297/188.01 |
| 5,580,125 | A * | 12/1996 | Alger | A47C 4/52 | 297/183.5 |
| 5,868,463 | A * | 2/1999 | MacKenzie | A47C 7/021 | 297/228.12 |
| 6,241,313 | B1 * | 6/2001 | Lenz | A47D 1/10 | 297/188.06 |
| 6,343,837 | B1 | 2/2002 | Gage | | |

(Continued)

*Primary Examiner* — Chi Q Nguyen

(74) *Attorney, Agent, or Firm* — Kyle A. Fletcher, Esq.

(57) ABSTRACT

The toddler stadium chair is adapted for use with bleacher or stadium seats. The toddler stadium chair is secured to a bleacher or stadium seat using a first plurality of straps. The toddler stadium chair is provisioned with a second plurality of straps that are used to secure the toddler into the toddler stadium chair after it has been secured to the bleacher or stadium seat. The toddler stadium chair comprises a seat, a first plurality of straps, and a second plurality of straps.

13 Claims, 5 Drawing Sheets

(56) References Cited

U.S. PATENT DOCUMENTS

| | | | | |
|---|---|---|---|---|
| 6,446,910 | B1 * | 9/2002 | Knoll | B60R 22/20 244/122 R |
| 6,692,072 | B2 | 2/2004 | Nelson et al. | |
| 6,848,746 | B2 * | 2/2005 | Gentry | A47C 7/748 297/180.11 |
| 6,929,325 | B1 * | 8/2005 | Goelo | A47C 1/16 297/183.5 |
| D557,511 | S | 12/2007 | Fore | |
| 7,708,342 | B2 | 5/2010 | Leach | |
| 7,854,476 | B1 * | 12/2010 | Liu | A47D 1/103 297/181 |
| 7,980,192 | B2 | 7/2011 | Flynn | |
| 9,033,412 | B2 * | 5/2015 | Reinck | B60N 2/24 244/122 R |
| 2004/0155506 | A1 * | 8/2004 | Gentry | A47C 7/748 297/380 |
| 2005/0116518 | A1 * | 6/2005 | Belgarde | A47D 1/103 297/254 |
| 2005/0269849 | A1 | 12/2005 | Mathis | |
| 2006/0022499 | A1 * | 2/2006 | Jones | A47C 1/16 297/352 |
| 2006/0163922 | A1 * | 7/2006 | Flannery | A47D 1/02 297/250.1 |
| 2008/0302840 | A1 * | 12/2008 | Missick | A45F 4/02 224/155 |
| 2009/0267393 | A1 * | 10/2009 | Coady | A47D 1/103 297/250.1 |
| 2012/0126598 | A1 | 5/2012 | Jones | |
| 2013/0257128 | A1 * | 10/2013 | Grace | A47C 4/04 297/340 |
| 2014/0360410 | A1 * | 12/2014 | Robinson | A47B 83/02 108/26 |
| 2016/0015180 | A1 * | 1/2016 | Ramirez | G09F 23/00 297/188.2 |

* cited by examiner

TODDLER STADIUM CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture, more specifically, portable furniture adapted for children.

SUMMARY OF INVENTION

The toddler stadium chair is adapted for use with bleacher or stadium seats. The toddler stadium chair is secured to a bleacher or stadium seat using a first plurality of straps. The toddler stadium chair is provisioned with a second plurality of straps that are used to secure the toddler into the toddler stadium chair after it has been secured to the bleacher or stadium seat.

These together with additional objects, features and advantages of the toddler stadium chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the toddler stadium chair in detail, it is to be understood that the toddler stadium chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toddler stadium chair.

It is therefore important that the claims be regarded as including such equivalent construction insofar as they do not depart from the spirit and scope of the toddler stadium chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the follow detailed description.

Figure 1:
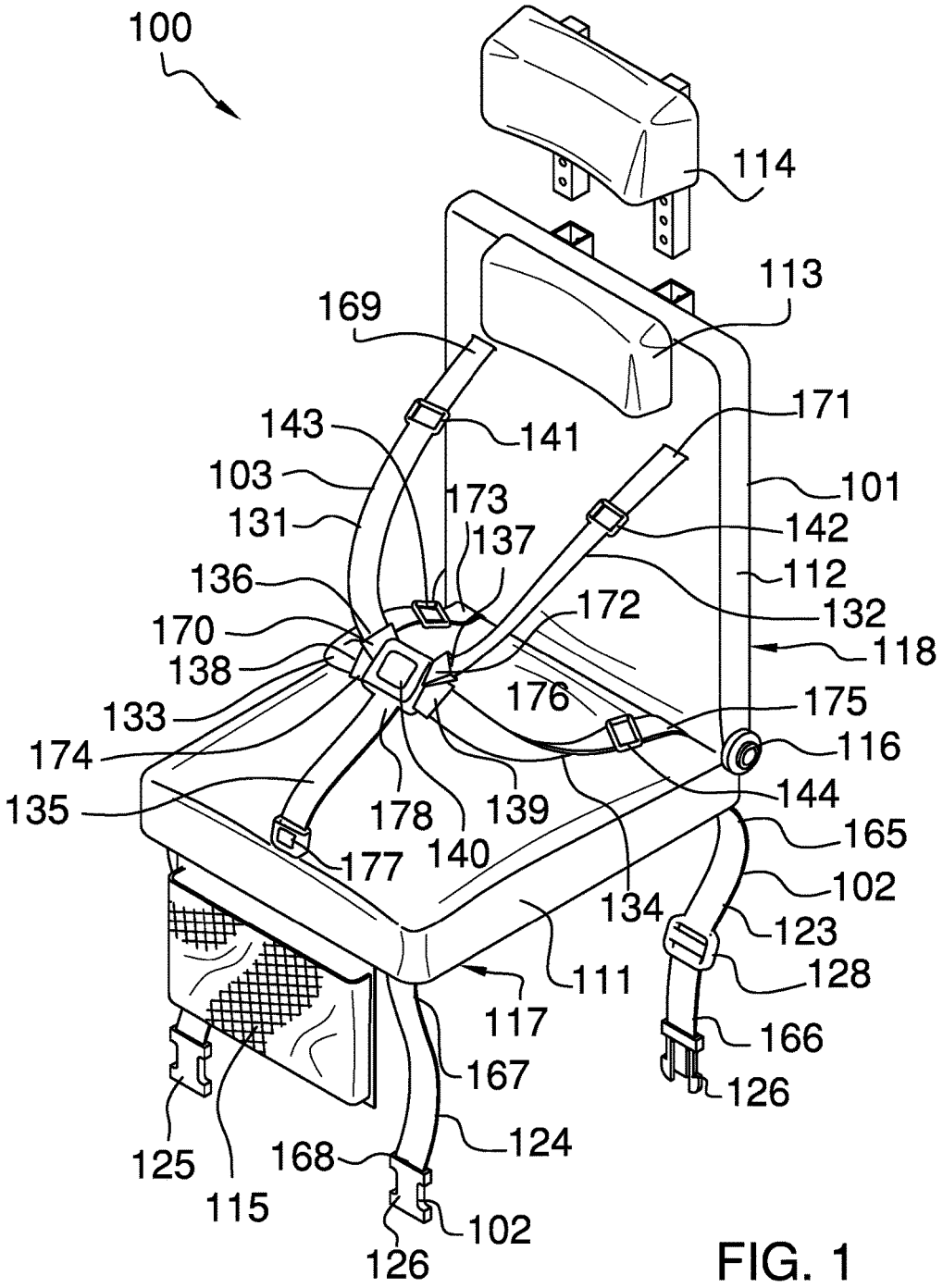
FIG. 1 is a perspective view of an embodiment of the disclosure.
Figure 2:
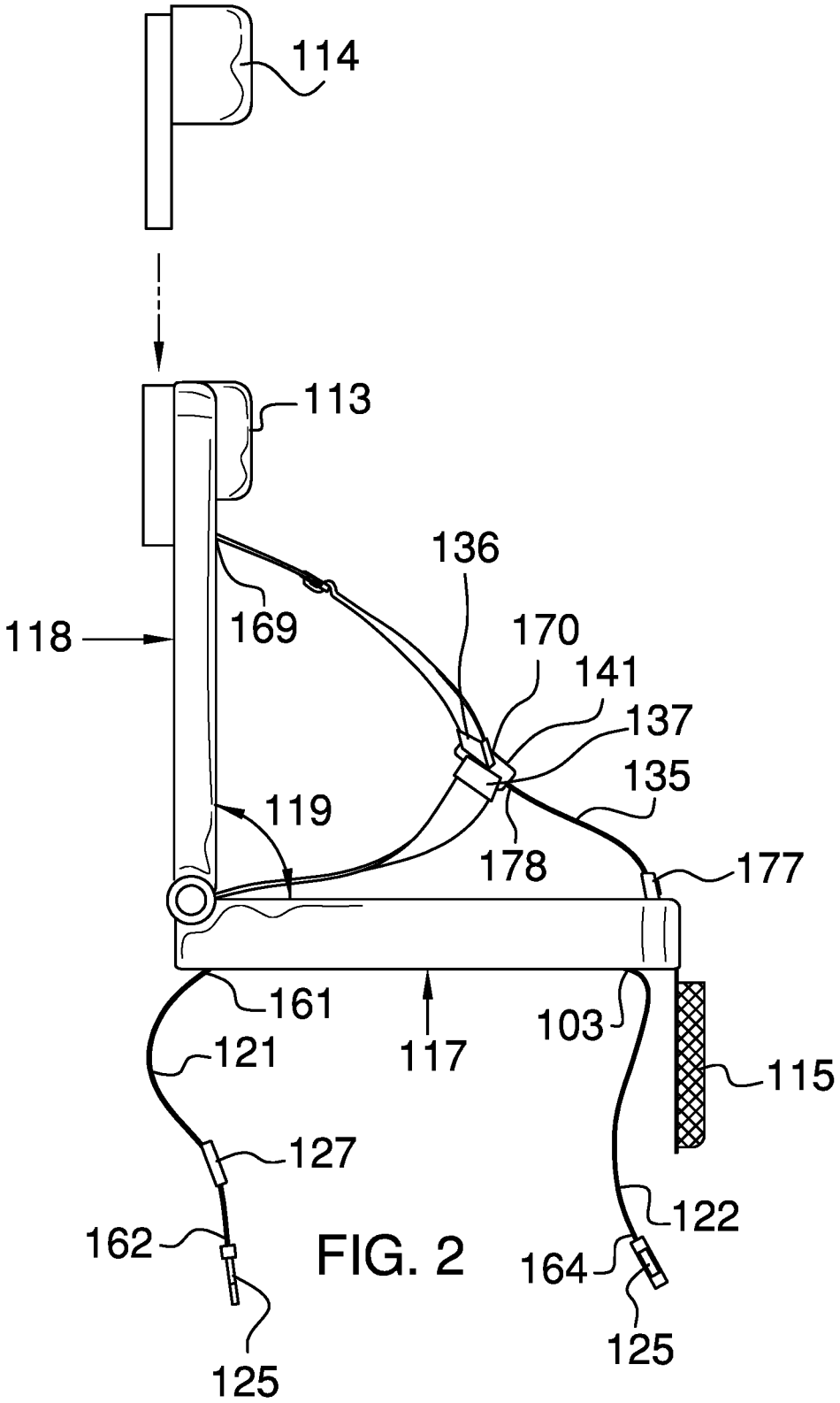
FIG. 2 is a side view of an embodiment of the disclosure.
Figure 3:
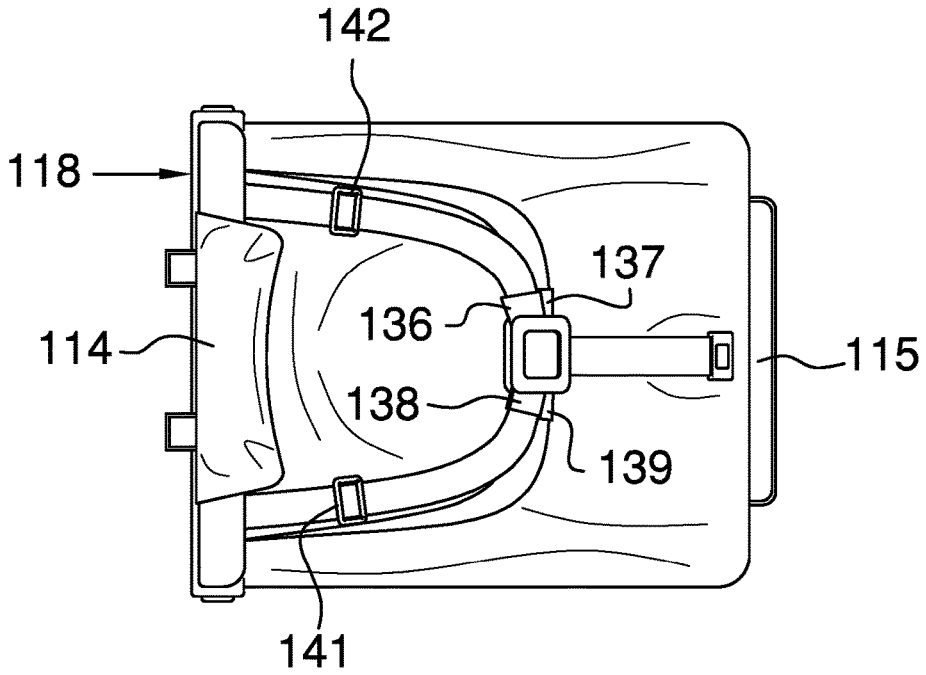
FIG. 3 is a top view of an embodiment of the disclosure.
Figure 4:
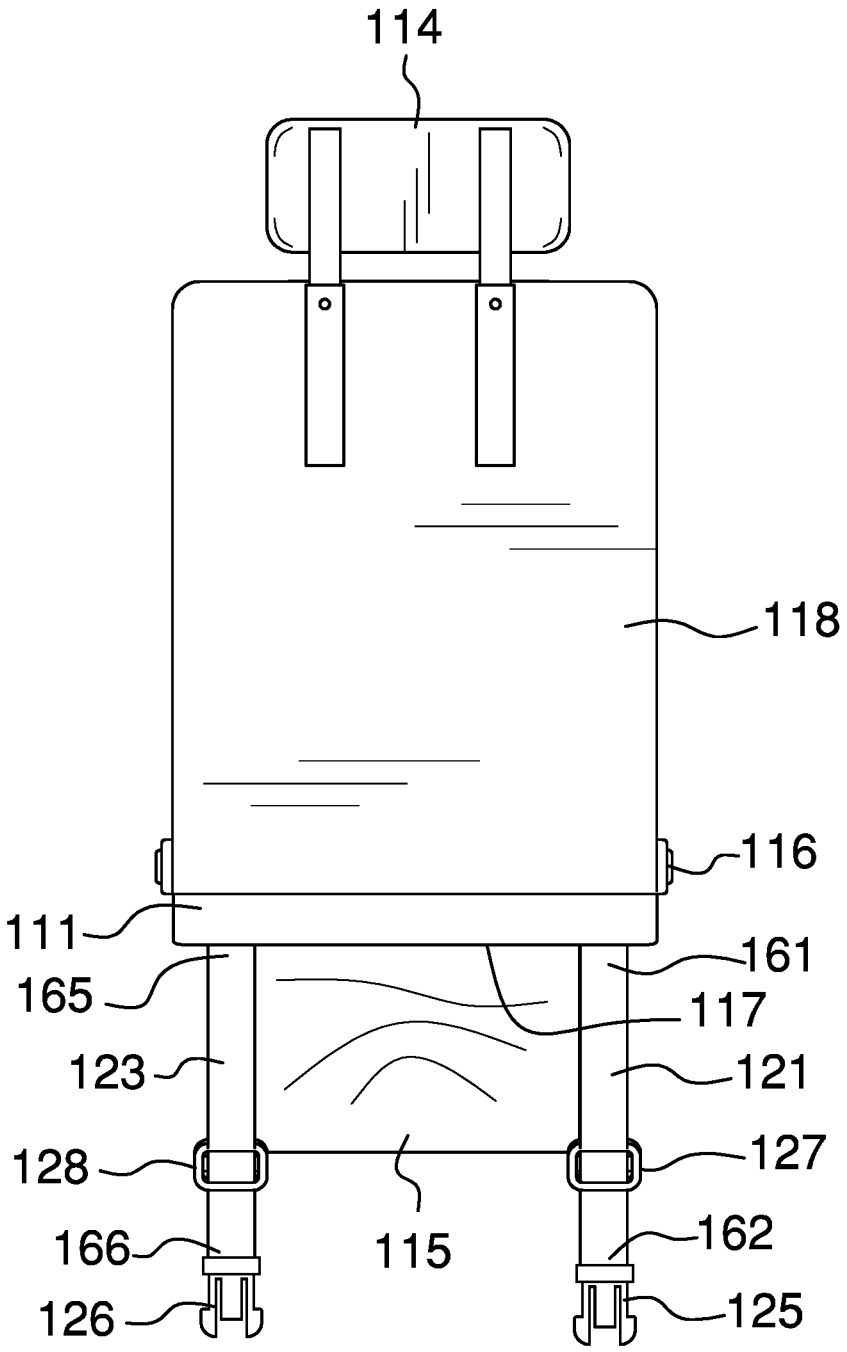
FIG. 4 is a back view of an embodiment of the disclosure.
Figure 5:
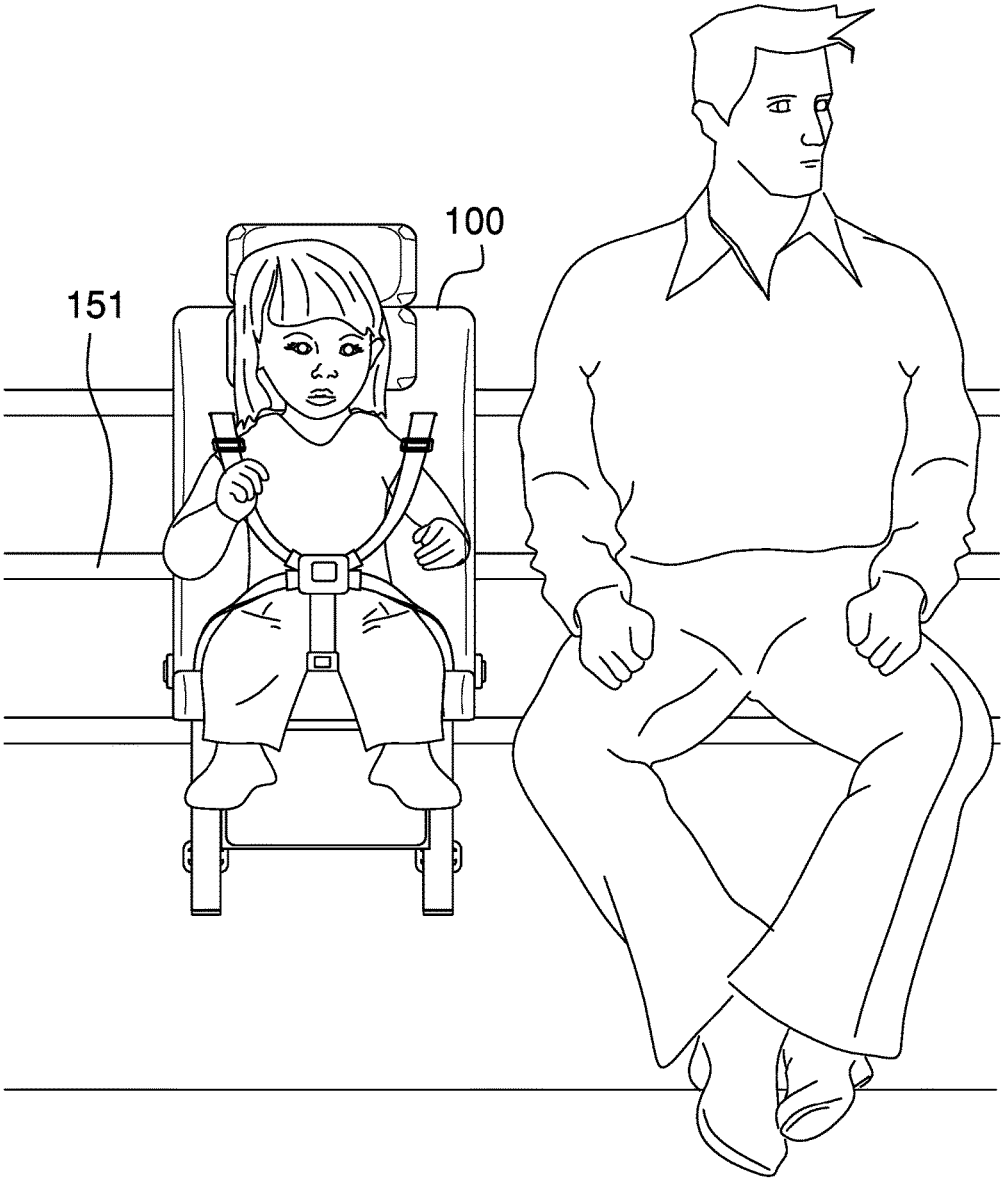
FIG. 5 is a front view of an embodiment of the disclosure.

Detailed reference will now be made to a first potential embodiment of the disclosure, which is illustrated in FIGS. 1 through 5.

The toddler stadium chair 100 (hereinafter invention) comprises a seat 101, a first plurality of straps 102, and a second plurality of straps 103. The invention 100 is adapted for use with bleacher or stadium seats 151. The invention 100 is secured to a bleacher or stadium seat 151 using a first plurality of straps 102. The invention 100 is provisioned with a second plurality of straps 103 that are used to secure the toddler into the invention 100 after it has been secured to the bleacher or stadium seat 151.

The seat 101 further comprises a seat cushion 111, a back cushion 112, a first headrest 113, a second headrest 114, a mesh bag 115, a hinge 116, a first backing 117 and a second backing 118. The first backing 117 is a flat rigid structure that is formed from plastic or metal. When the invention 100 is in use, the first backing 117 is placed upon the bleacher or stadium seat 151 that the invention 100 will be secured upon. The second backing 118 is a flat rigid structure that is formed from plastic or metal. The second backing 118 will be the back rest of the invention 100. As shown most clearly in FIGS. 1 and 2, the first backing 117 and the second backing 118 are joined using the hinge 116 which is a commercially available locking hinge that allows the relative angle 119 between the first backing 17 and the second backing 118 to be adjusted and then locked into position. The seat cushion 111 is a commercially available pad that is attached to the first backing 117.

The back cushion 112 is a commercially available pad that is attached to the second backing 118. The first headrest 113 is a pad that is attached to the seat cushion 111 such that the first headrest 113 projects away from the seat cushion 111 in a direction away from the first backing 117. As shown most clearly in FIG. 2, the second head rest 114 is a readily and commercially available headrest for chairs and seats. The second headrest 114 is an extendable headrest that is mounted directly on the second backing 118 such that the second headrest 114 can be extended away from the second backing 118 in the direction away from the first backing 117 and the seat cushion 111. The second headrest 114 is provided to accommodate the growth of the toddler over the working life of the invention 100. As shown most clearly in FIG. 1, the mesh bag 115 is attached to the first backing 117 to accommodate the storage of objects.

The first plurality of straps 102 further comprises a first webbing 121, a second webbing 122, a third webbing 123, a fourth webbing 124, a first buckle 125, a second buckle 126, a first ring and slider 127, and a second ring and slider 128. The first webbing 121 is further defined with a first end 161 and a second end 162. The second webbing 122 is further defined with a third end 163 and a fourth end 164. The third webbing 123 is further defined with a fifth end 165 and a sixth end 166. The fourth webbing 124 is further defined with a seventh end 167 and an eighth end 168. The first buckle 125 is a readily and commercially available quick release buckle. The second buckle 126 is a readily and commercially available quick release buckle. The first ring and slider 127 and the second ring and slider 128 are commercially available ring and slider arrangements. The first end 161 of the first webbing 121, the third end 163 of the second webbing 122, the fifth end 165 of the third webbing 123 and the seventh end 167 of the fourth webbing 124 are each attached to the first base 117.

The second end 162 of the first webbing 121 is threaded through the slider component of the first ring and slider 127. The second end 162 of the first webbing 121 is fitted with the male connector of the first buckle 125. The male connector of the first buckle 125 is further formed with the ring component of the first ring and slider 127. The fourth end 164 of the second webbing 122 is fitted with the female connector of the first buckle 125. The sixth end 166 of the third webbing 123 is threaded through the slider component of the second ring and slider 128. The sixth end 166 of the third webbing 123 is fitted with the male connector of the second buckle 126. The male connector of the second buckle 126 is further formed with the ring component of the second ring and slider 128. The eighth end 168 of the fourth webbing 124 is fitted with the female connector of the second buckle 126.

The second plurality of straps 103 further comprises a fifth webbing 131, a sixth webbing 132, a seventh webbing 133, an eighth webbing 134, a ninth webbing 135, a third male buckle connector 136, a fourth male buckle connector 137, a fifth male buckle connector 138, a sixth male buckle connector 139, and a seventh female buckle connector 140, a fourth ring and slider 142, a fifth ring and slider 143, and a sixth ring and slider 144. The fifth webbing 131 is further defined with a ninth end 169 and a tenth end 170. The sixth webbing 132 is further defined with an eleventh end 171 and a twelfth end 172. The seventh webbing 133 is further defined with a thirteenth end 173 and a fourteenth end 174. The eighth webbing 134 is further defined with a fifteenth end 175 and a sixteenth end 176. The ninth webbing 135 is further defined with a seventeenth end 177 and an eighteenth end 178.

The third male buckle connector 136, the fourth male buckle connector 137, the fifth male buckle connector 138, the sixth male buckle connector 139, and a seventh female buckle connector 140 are commercially available components that are combined to form a quick release buckle for a five point harness. The seventh female buckle connector 140 is designed to receive the third male buckle connector 136, the fourth male buckle connector 137, the fifth male buckle connector 138, and the sixth male buckle connector 139 in a quick release fashion. The third ring and slider 141, the fourth ring and slider 142, the fifth ring and slider 143, and the sixth ring and slider 144 are commercially available ring and slider arrangements. The third male buckle connector 136 further comprises the ring component of the third ring and slider 141. The fourth male buckle connector 137 further comprises the ring component of the fourth ring and slider 142. The fifth male buckle connector 138 further comprises the ring component of the fifth ring and slider 143. The sixth male buckle connector 139 further comprises the ring component of the sixth ring and slider 144. The ninth end 169 of the fifth webbing 131, the eleventh end 171 of the sixth webbing 132, the thirteenth end 173 of the seventh webbing 133, and the fifteenth end 175 of the eighth webbing 134 are attached through the back cushion 112 to the second backing 118. The seventeenth end 177 of the ninth webbing 135 is attached through the seat cushion 111 to the first backing 117.

The tenth end 170 of the fifth webbing 131 is threaded through the slider component of the third ring and slider 141. The third male buckle connector 136 is attached to the tenth end 170 of the fifth webbing 131. The twelfth end 172 of the sixth webbing 132 is threaded through the slider component of the fourth ring and slider 142. The fourth male buckle connector 137 is attached to the twelfth end 172 of the sixth webbing 132. The fourteenth end 174 of the seventh webbing 133 is threaded through the slider component of the fourth ring and slider 142. The fifth male buckle connector 138 is attached to the fourteenth end 174 of the seventh webbing 133. The sixteenth end 176 of the eighth webbing 134 is threaded through the slider component of the fifth ring and slider 143. The sixth male buckle connector 139 is attached to the sixteenth end 176 of the eighth webbing 134. The seventh female buckle connector 140 is attached to the eighteenth end 178 of the ninth webbing 135.

To use the invention 100, the first backing 117 is cinched to a bleacher or stadium seat 151 using the first plurality of straps 102. Specifically, the first webbing 121, the second webbing 122, the third webbing 123 and the fourth webbing 124 are wrapped around the bleacher or stadium seat 151 and are secured by inserting the male connector of the first buckle 125 into the female connector of the first buckle 125 and by inserting the male connector of the second buckle 126 into the female connector of the second buckle 126. The first plurality of straps 102 are tightened to the bleacher or stadium seat 151 using the first ring and slider 127 and the second ring and slider 128.

The relative angle 119 between the first backing 117 and the second backing 118 is adjusted by rotating position of the second backing 118 relative to the first backing 117 using the hinge 116 as a pivot. The hinge 116 is then locked. The toddler is then strapped into the invention 100 using the second plurality of straps 103. Specifically, the ninth webbing 135 is brought between the legs of the toddler such that the seventh female buckle connector 140 rests in the toddler's lap. The fifth webbing 131 is positioned over the toddler's right shoulder and the third male buckle connector 136 is inserted into the seventh female buckle connector 140. The sixth webbing 132 is positioned over the toddler's left shoulder and the fourth male buckle connector 137 is inserted into the seventh female buckle connector 140. The seventh webbing 133 is positioned over the toddler's right hip and the fifth male buckle connector 138 is inserted into the seventh female buckle connector 140. The eighth webbing 134 is positioned over the toddler's right shoulder and the sixth male buckle connector 139 is inserted into the seventh female buckle connector 140. The second plurality of straps 103 are adjusted using the third ring and slider 141, the fourth ring and slider 142, the fifth ring and slider 143 and the sixth ring and slider 144.

The first backing 117 and the second backing 118 are both formed from a rigid metal or plastic. Suitable metals include, but are not limited to, aluminum. Suitable plastics include, but are not limited to polypropylene. The seat cushion 111 and the back cushion 112 are commercially purchased polyurethane foam cushions. The seat cushion 111 and the back cushion 112 can be connected to the first backing 117 and the second backing 118 using hook and loop fasteners or glue. The hinge 116 is commercially available. The remaining components described in this disclosure are readily and commercially available. The design and use of quick release buckles as well as ring and sliders is well known and documented in the textile arts.

The following definitions were used in this disclosure:

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Fastener: As used in this disclosure, a fastener is a device that is used to join or affix two objects. Fasteners generally comprise a first part which, is attached to the first object and a second part which is attached to the second object.

Headrest: As used in this disclosure, a headrest is a pad that attaches to or extends from the back of a seat.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook or loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Pad: As used in this disclosure, a pad is a mass of soft material used as a filling or for protection against damage or injury.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Strap: As used in this disclosure a strap is a strip of leather, cloth, or other flexible material, often with a buckle, that is used to fasten, secure, carry, or hold onto something.

Strip: As used in this disclosure, the term describes a long thin object of uniform width. Strips are often rectangular in shape.

Textile: As used in this disclosure, a textile is a material that is woven, knitted, braided or felted. Synonyms in common usage for this definition include fabric and cloth.

Toddler: As used in this disclosure, a toddler is a human child between the ages of one and three who has learned to walk.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A chair comprising:

a seat, a first plurality of straps, and a second plurality of straps;

wherein the chair is adapted for use with bleacher or stadium seats;

wherein the chair is adapted to be secured to a bleacher or stadium seat using the first plurality of straps;

wherein the second plurality of straps is adapted to secure a toddler into the chair after the chair has been adapted to be secured to the bleacher or stadium seat;

wherein the seat further comprises a seat cushion, a back cushion, a first headrest, a second headrest, a mesh bag, a hinge, a first backing and a second backing;

wherein the first backing is a flat structure;

wherein the second backing is a flat structure;

wherein the first backing and the second backing are joined with the hinge;

wherein the seat cushion is a first pad that is attached to the first backing;

wherein the back cushion is a second pad that is attached to the second backing;

wherein the first headrest is a third pad that is attached to the seat cushion such that the first headrest projects away from the seat cushion in a direction away from the first backing.

2. The chair according to claim 1 wherein the second headrest is an extendable headrest that is mounted directly on the second backing such that the second headrest can be extended away from the second backing in the direction away from the first backing and the seat cushion.

3. The chair according to claim 2 wherein the first plurality of straps further comprises a first webbing, a second webbing, a third webbing, a fourth webbing, a first buckle, a second buckle, a first ring and slider, and a second ring and slider;

wherein the first webbing is further defined with a first end and a second end;

wherein the second webbing is further defined with a third end and a fourth end;

wherein the third webbing is further defined with a fifth end and a sixth end;

wherein the fourth webbing is further defined with a seventh end and an eighth end.

4. The chair according to claim 3 wherein the first buckle is a quick release buckle;

wherein the second buckle is a quick release buckle.

5. The chair according to claim 4 wherein the first end of the first webbing, the third end of the second webbing, the fifth end of the third webbing and the seventh end of the fourth webbing are each attached to the first base.

6. The chair according to claim 5 wherein the second end of the first webbing is threaded through a slider component of the first ring and slider wherein the second end of the first webbing is fitted with the male connector of the first buckle;

the fourth end of the second webbing is fitted with the female connector of the first buckle;

wherein the sixth end of the third webbing is threaded through the slider component of the second ring and slider;

wherein the sixth end of the third webbing is fitted with the male connector of the second buckle;

wherein the eighth end of the fourth webbing is fitted with the female connector of the second buckle.

7. The chair according to claim 6 wherein the male connector of the first buckle is further formed with the ring component of the first ring and slider;

wherein the male connector of the second buckle is further formed with the ring component of the second ring and slider.

8. The chair according to claim 7 wherein the second plurality of straps further comprises a fifth webbing, a sixth webbing, a seventh webbing, an eighth webbing, a ninth webbing, a third male buckle connector, a fourth male buckle connector, a fifth male buckle connector, a sixth male buckle connector, and a seventh female buckle connector, a fourth ring and slider, a fifth ring and slider, and a sixth ring and slider;

wherein the fifth webbing is further defined with a ninth end and a tenth end;

wherein the sixth webbing is further defined with an eleventh end and a twelfth end;

wherein the seventh webbing is further defined with a thirteenth end and a fourteenth end;

wherein the eighth webbing is further defined with a fifteenth end and a sixteenth end;

wherein the ninth webbing is further defined with a seventeenth end and an eighteenth end.

9. The chair according to claim 8 wherein the third male buckle connector, the fourth male buckle connector, the fifth male buckle connector, the sixth male buckle connector, and a seventh female buckle connector combine to form a quick release buckle for a five point harness.

10. The chair according to claim 9 wherein the seventh female buckle connector is designed to receive the third male buckle connector, the fourth male buckle connector, the fifth male buckle connector, and the sixth male buckle connector.

11. The chair according to claim 10 wherein the third male buckle connector further comprises the ring component of the third ring and slider;

wherein the fourth male buckle connector further comprises the ring component of the fourth ring and slider;

wherein the fifth male buckle connector further comprises the ring component of the fifth ring and slider;

wherein the sixth male buckle connector further comprises the ring component of the sixth ring and slider.

12. The chair according to claim 11 wherein the ninth end of the fifth webbing, the eleventh end of the sixth webbing, the thirteenth end of the seventh webbing, and the fifteenth end of the eighth webbing are attached through the back cushion to the second backing wherein the seventeenth end of the ninth webbing is attached through the seat cushion to the first backing.

13. The chair according to claim 12 wherein the tenth end of the fifth webbing is threaded through the slider component of the third ring and slider;

wherein the third male buckle connector is attached to the tenth end of the fifth webbing;

wherein the twelfth end of the sixth webbing is threaded through the slider component of the fourth ring and slider;

wherein the fourth male buckle connector is attached to the twelfth end of the sixth webbing;

wherein the fourteenth end of the seventh webbing is threaded through the slider component of the fourth ring and slider;

wherein the fifth male buckle connector is attached to the fourteenth end of the seventh webbing;

wherein the sixteenth end of the eighth webbing is threaded through the slider component of the fifth ring and slider;

wherein the sixth male buckle connector is attached to the sixteenth end of the eighth webbing;

wherein the seventh female buckle connector is attached to the eighteenth end of the ninth webbing.

* * * * *